US005887465A

United States Patent [19]

Shen

[11] Patent Number: 5,887,465

[45] Date of Patent: Mar. 30, 1999

[54] TORSION SPRING POSITIONING MEANS OF A CYLINDRICAL LOCK

[76] Inventor: Mu-Lin Shen, No. 32, Lane 76, Sec. 5, Fu-An Road, Tainan, Taiwan

[21] Appl. No.: 25,016

[22] Filed: Feb. 17, 1998

[51] Int. Cl.[6] ..... E05B 13/10

[52] U.S. Cl. ..... 70/224; 70/452; 70/DIG. 36; 292/336.3; 292/356; 292/357; 292/DIG. 61

[58] Field of Search ..... 70/224, 452, DIG. 36, 70/DIG. 54, DIG. 55; 292/336.3, 347, 356, 357, DIG. 61

[56] References Cited

U.S. PATENT DOCUMENTS

| | | | |
|---|---|---|---|
| 5,190,327 | 3/1993 | Lin | 292/348 |
| 5,286,074 | 2/1994 | Lin | 292/336.3 |
| 5,322,333 | 6/1994 | Norton, II et al. | 292/336.3 |
| 5,481,890 | 1/1996 | Millman | 292/336.3 X |
| 5,562,317 | 10/1996 | Kuo et al. | 292/359 |
| 5,617,749 | 4/1997 | Park | 292/336.3 X |
| 5,636,882 | 6/1997 | Hook | 292/336.3 X |
| 5,666,833 | 9/1997 | Gao et al. | 292/336.3 X |
| 5,727,406 | 3/1998 | Banducci | 292/336.3 X |

*Primary Examiner*—Lloyd A. Gall
*Attorney, Agent, or Firm*—Kirkpatrick & Lockhart LLP

[57] ABSTRACT

A torsion spring positioning device of a cylindrical lock includes a spindle outer casing through which a spindle extends and the spindle outer casing has two protrusions extending radially inward from an inner periphery thereof. The spindle has two slots defined in a periphery thereof and two stops extending radially outward from the periphery thereof so that two legs of the torsion spring respectively abut an end of the corresponding stop and an end of the corresponding protrusion. A washer is mounted to the spindle and has two notches defined in an outer periphery thereof so as to respectively receive the protrusions. A C-shaped clamping member is mounted to the spindle and has two stubs extending radially inward from an inner periphery thereof so as to be received in the slots.

4 Claims, 4 Drawing Sheets

TORSION SPRING POSITIONING MEANS OF A CYLINDRICAL LOCK

BACKGROUND OF THE INVENTION

1. Field of the Invention

The present invention relates to a torsion spring positioning means and, more particularly, to a torsion spring positioning means of a cylindrical lock. The positioning means allows the torsion spring to be replaced easily and quickly.

2. Brief Description of the Prior Art

FIG. 1 shows a cross-sectional view of a conventional cylindrical lock including a retractor 43 received between two spindle outer casings 45, 46 in a door, a latch bolt assembly 44 laterally connected to the retractor 43, two spindles 41, 42 respectively extending from two opposite directions of the retractor 43 and located in the spindle outer casings 45, 46 so as to be connected to respective handles 50, 51 so that when rotating either one of the handles, the latch bolt assembly 44 is operated. In order to keep the handles 50, 51 always in a horizontal position when no rotational action is applied thereto, two torsion springs 412, 422 are respectively mounted to the two spindles 41, 42. Each of the spindles 41, 42 has a hook member 411/421 extending radially outward therefrom so that one of two ends of the torsion spring 412/422 contacts against one of two sides of the hook member 411/421 corresponding thereto, and the other end of the torsion spring 412/422 contacts against the spindle outer casing 45/46 and the other side of the hook member 411/421 corresponding thereto. Therefore, the biasing force of each of the two torsion springs 412, 422 will return the respective handle 50/51 to the horizontal position. In order to position the torsion springs 412, 422, each of the spindle outer casings 45, 46 is formed to have a convergent distal end 451/461 within which a respective washer 413/423 is received so that the washer 413/423 is retained in the respective convergent distal end 451/461 and limits the torsion spring 412/422 from withdrawing from the spindle outer casing 45/46. Although the two torsion springs 412, 422 are well positioned, once any one of the two torsion springs 412, 422 needs to be replaced, a special tool is required to deform the convergent distal end 451/461 of each of the spindle outer casings 45, 46, or the lock has to be discarded. Another conventional cylindrical lever type lock is disclosed in applicant's U.S. Pat. No. 4,921,289, "Cylindrical Lever Type Lock Structure For Handicapped People". In this type of cylindrical lever type lock, the torsion spring also cannot be replaced and faces the same problems described above.

The present invention intends to provide a torsion spring positioning means of a cylindrical lock so as to mitigate and/or obviate the above-mentioned problems.

SUMMARY OF THE INVENTION

The present invention provides a torsion spring positioning means of a cylindrical lock, comprising at least one spindle outer casing through which a spindle extends, and the spindle outer casing having two protrusions extending radially inward from an inner periphery thereof. The spindle has two slots defined in a periphery thereof and two stops extend radially outward from the periphery thereof. Each pair of the stops and the protrusions are located in alignment with each other. Two legs of the torsion spring respectively abut an end of the corresponding stop and an end of the corresponding protrusion.

A washer is mounted to the spindle and has two notches defined in an outer periphery thereof so as to respectively receive the protrusions. A C-shaped clamping member is mounted to the spindle and has two stubs extending radially inward from an inner periphery thereof so as to be received in the slots.

It is an object of the present invention to provide a torsion spring positioning means of a cylindrical lock such that the torsion spring is easily replaced.

It is another object of the present invention to provide a torsion spring positioning means of a cylindrical lock such that there no special tools and machines needed when replacing the torsion spring.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
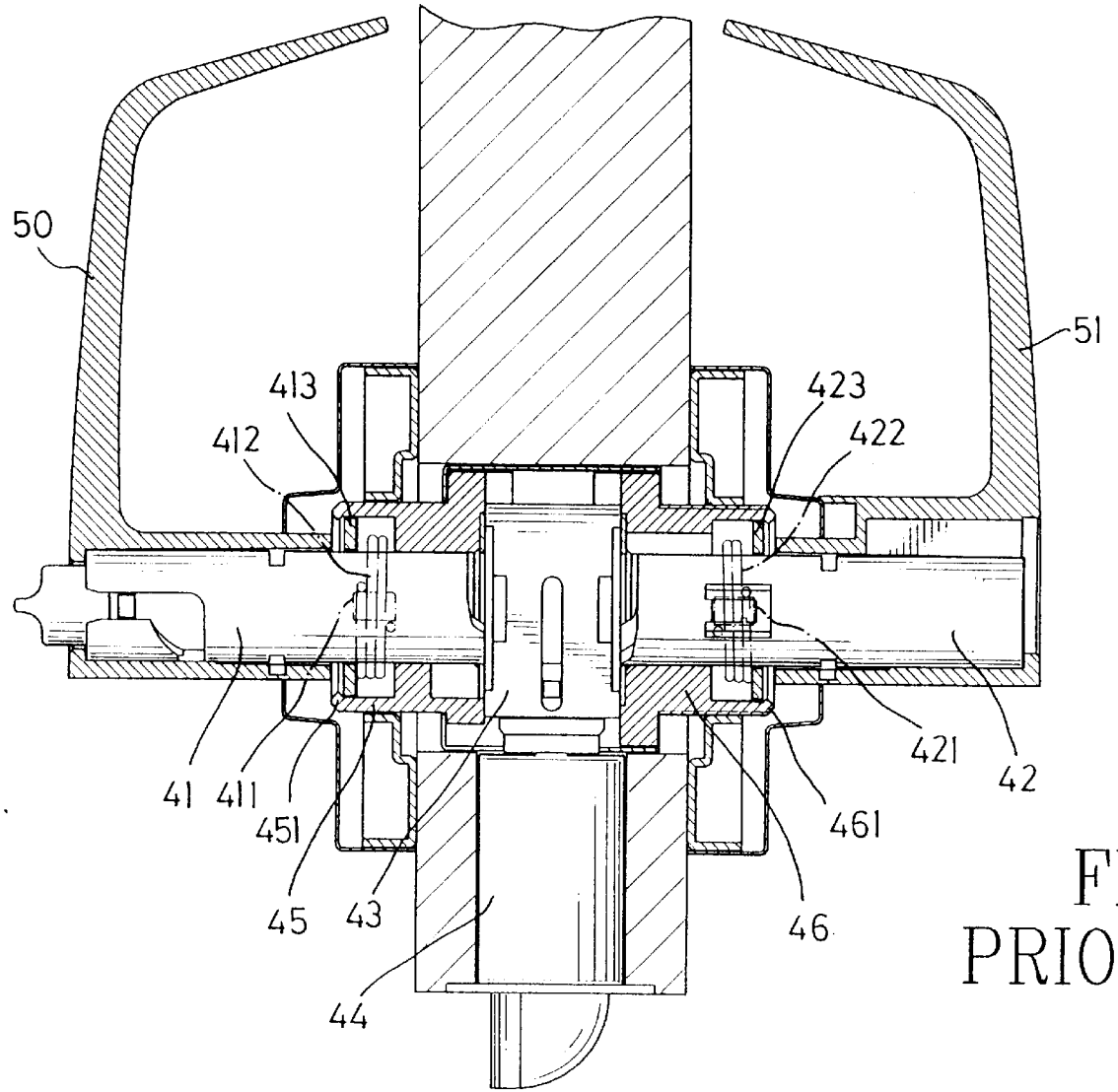
FIG. 1 PRIOR ART
FIG. 1 is a side elevational view, partly in section, of a cylindrical lock and shows two torsion springs are positioned by a conventional structure.
Figure 2:
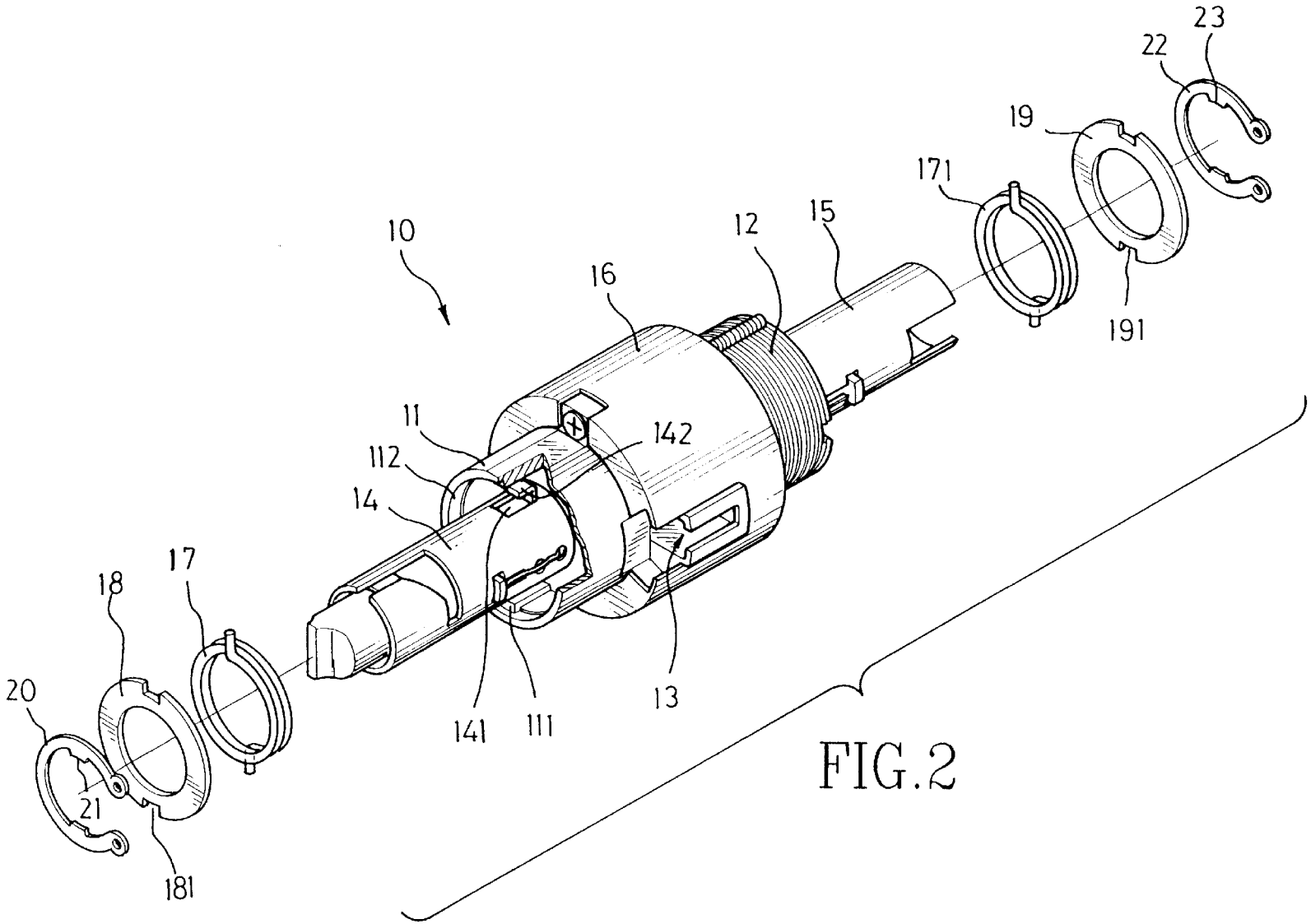
FIG. 2 is an exploded view of a torsion spring positioning means in accordance with the present invention.
Figure 3:
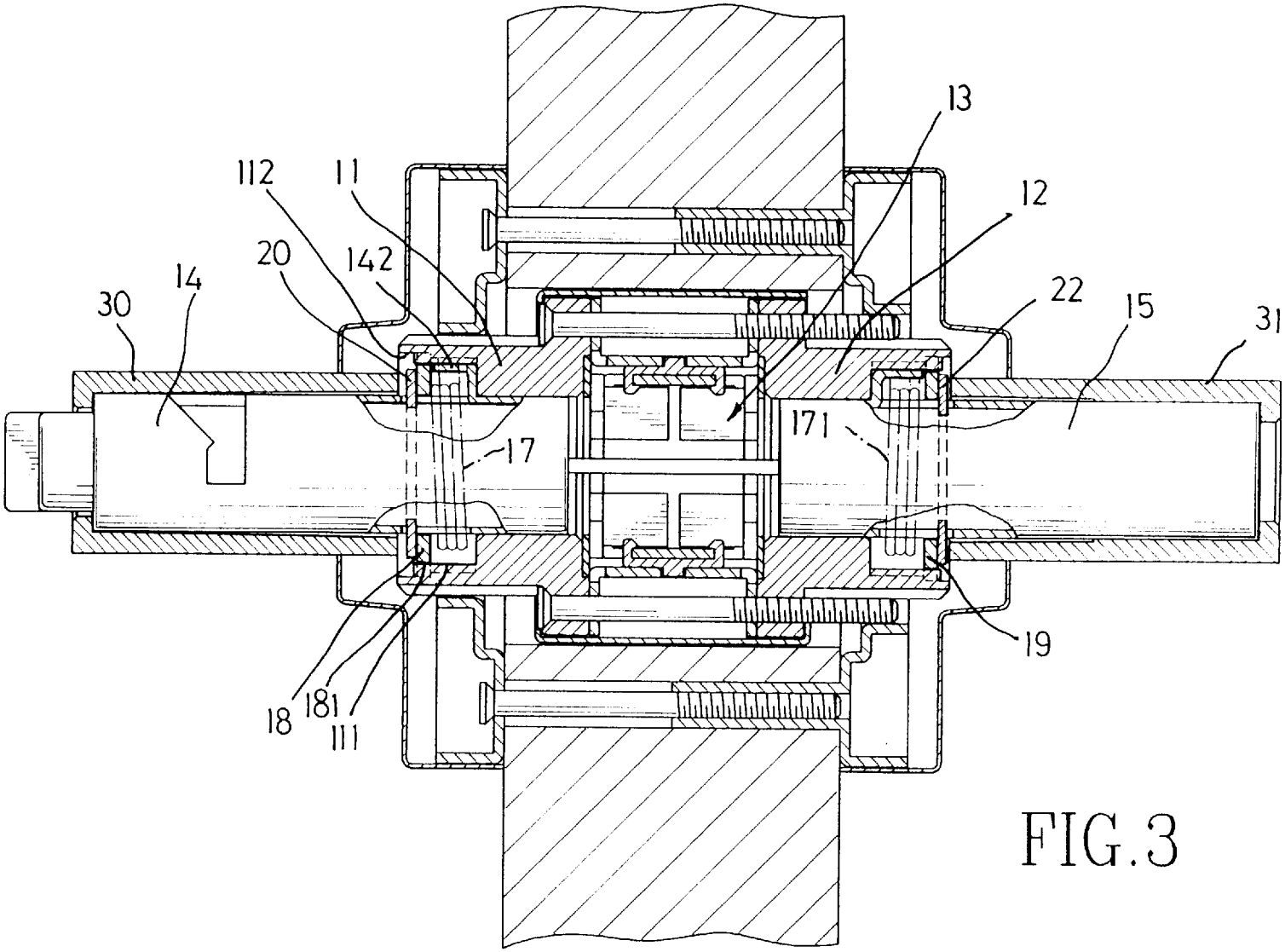
FIG. 3 is a side elevational view, partly in section, of a cylindrical lock having the torsion spring positioning means disposed therein.

Referring to the drawings and initially to FIGS. 2 and 3, a cylindrical lock 10 generally includes a retractor 13 received in a casing 16, two spindles 14 and 15 respectively extending from the casing 16 and in two opposite directions so as to be connected to two respective handles 30, 31 (FIG. 3). A latch bolt assembly (not shown) is operatably connected to the retractor 13 by rotating either one of the handles 30, 31. A torsion spring positioning means of a cylindrical lock of the present invention comprises two spindle outer casings 11, 12 respectively mounted to the two spindles 14, 15. Each of the spindle outer casings 11, 12 has two protrusions 111 extending radially inward from an inner periphery thereof, the two protrusions 111 being located diametrically opposite with each other. Each of the spindle outer casings 11, 12 further has a groove 112 defined in the inner periphery thereof. The spindles 14, 15 each have two slots 141 defined in a periphery thereof and located diametrically opposite with each other so that each of the protrusions 111 faces to a respective slot 141. Two stops 142 extend radially outward from the outer periphery of each one of the spindles 14, 15 and each one of the stops 142 extends from a periphery defining the slot 141 corresponding thereto so that each pair of the stops 142 and the protrusions 111 are in alignment with each other.

Figure 5:
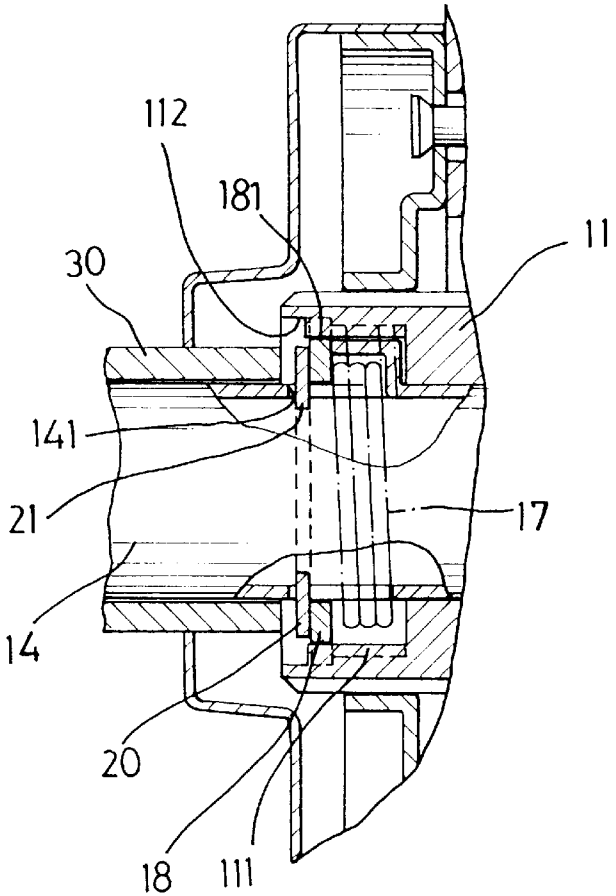
FIG. 5 is a side elevational view, partly in section and at a slightly enlarged scale, of the torsion spring positioning means of the present invention.
Figure 4:
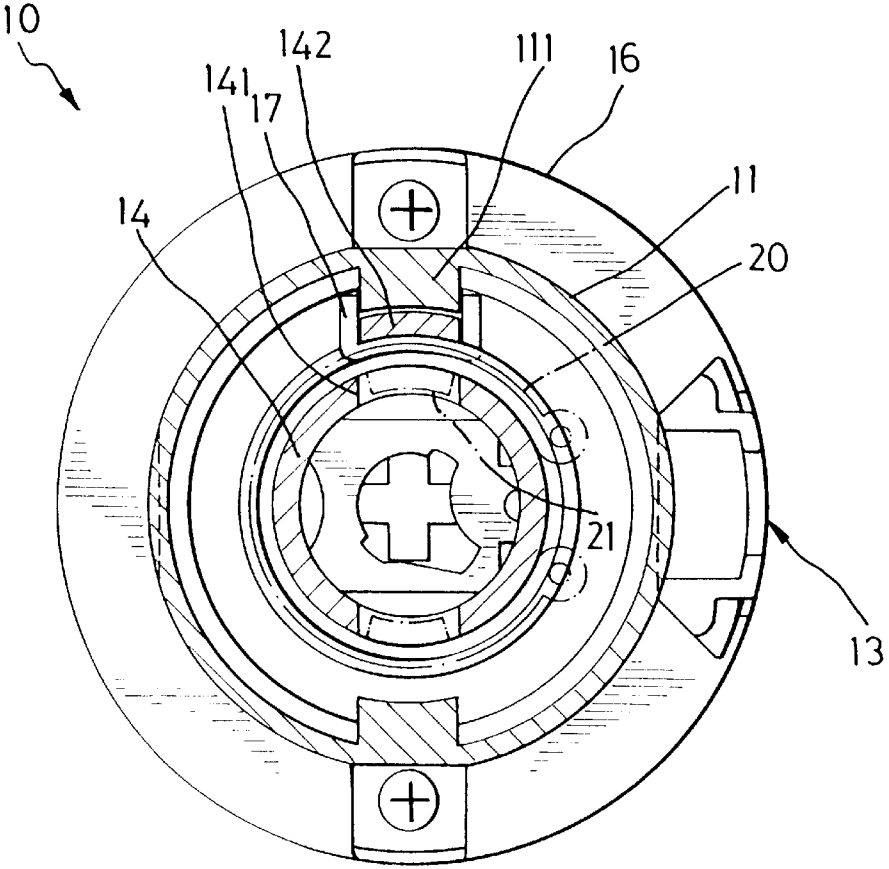
FIG. 4 is an illustrative end view to show the torsion spring positioning means of the present invention.

Further referring to FIGS. 4 and 5, two torsion springs 17, 171 each have two legs and are respectively mounted to the spindles 14, 15. The two legs of each of the torsion springs 17, 171 respectively contact two sides of a corresponding pair of the stop 142 and the protrusion 111 as shown in FIG. 4, so as to provide a biasing force to always keep the handle 30/31 in a horizontal position.

Two washers 18, 19 are respectively mounted to the spindles 14, 15 and received in the groove 112 corresponding thereto. Each of the washers 18, 19 has two notches 181/191 defined in an outer periphery thereof so as to respectively receive the protrusions 111 and each of the washers 18, 19 abuts a respective distal edge of the two stops 142 corresponding thereto. Two C-shaped clamping members 20, 22 are respectively mounted to the spindles 14, 15 and each have two stubs 21/23 extending radially inward from an inner periphery thereof so that the two stubs 21/23 are received in the slots 141 corresponding thereto to prevent the washer 18/19 and the torsion spring 17/171 from loosening from the spindle 14/15.

When the torsion spring 17/171 is to be replaced or adjusted, a maintenance worker uses a pair of pliers, for example, to widen the C-shaped clamping member 20/22 to withdraw the two stubs 21/23 from the slots 141 so that the washer 18/19 and the torsion spring 17/171 are able to be removed from the spindle 14/15. This process to replace the torsion is obviously much simpler when compared with the conventional process.

Although the invention has been explained in relation to its preferred embodiment, it is to be understood that many other possible modifications and variations can be made without departing from the spirit and scope of the invention as hereinafter claimed.

What is claimed is:

1. A torsion spring positioning means of a cylindrical lock, comprising:

at least one spindle outer casing through which a spindle extends, said spindle outer casing having two protrusions extending radially inward from an inner periphery thereof, said spindle having two slots defined in a periphery thereof and two stops extending radially outward from said periphery thereof wherein each of said stops extends from a periphery defining said slot corresponding thereto, each pair of said stops and said protrusions being in alignment with each other, each one of two ends of each one of said stops and said protrusions are suitable to contact a corresponding one of two legs of said torsion spring;

a washer mounted to said spindle and having two notches defined in an outer periphery thereof so as to respectively receive said protrusions, and a C-shaped clamping member mounted to said spindle and having two stubs extending radially inward from an inner periphery thereof so that said two stubs are received in said slots.

2. The torsion spring positioning means as claimed in claim 1 wherein said spindle outer casing has a groove defined in said inner periphery thereof so as to receive said washer therein.

3. The torsion spring positioning means as claimed in claim 1 wherein said two protrusions are located diametrically opposite with each other in said inner periphery of said spindle outer casing.

4. The torsion spring positioning means as claimed in claim 1 wherein said washer abuts a distal edge of each of said two stops.

* * * * *